United States Patent [19]

Stover et al.

[11] Patent Number: 4,780,165

[45] Date of Patent: Oct. 25, 1988

[54] METHOD AND APPARATUS FOR ENCASING DRAINAGE PIPES

[75] Inventors: Hermann Stover; Alfons Meyer, both of Twistringen, Fed. Rep. of Germany

[73] Assignee: Corma, Inc., Ontario, Canada

[21] Appl. No.: 907,226

[22] Filed: Sep. 15, 1986

[30] Foreign Application Priority Data

Sep. 16, 1985 [DE] Fed. Rep. of Germany ..... 3533135

[51] Int. Cl.[4] ..... B65H 81/06

[52] U.S. Cl. ..... 156/169; 29/728; 156/192; 156/195; 156/201; 156/203; 156/276; 156/425; 156/428; 156/461; 156/466

[58] Field of Search ..... 210/489, 170; 405/43, 405/45, 48; 29/430, 455 R, 728; 156/54, 171, 189, 195, 192, 201, 203, 276, 425, 169, 172, 184, 185, 187, 215–216, 428–429, 443, 461, 466; 198/625; 264/171–174, 310

[56] References Cited

U.S. PATENT DOCUMENTS

| | | | |
|---|---|---|---|
| 775,541 | 11/1904 | McConnell | 156/203 |
| 3,068,133 | 12/1962 | Cilker et al. | 156/171 |
| 3,357,564 | 12/1967 | Medford et al. | 210/489 |
| 3,406,832 | 10/1968 | Ruschman et al. | 210/489 |
| 3,440,822 | 4/1969 | Hegler | 61/10 |
| 3,563,825 | 2/1971 | Segura et al. | 156/425 |
| 3,740,291 | 6/1973 | Mallard | 156/195 |
| 3,784,667 | 1/1974 | Drostholm et al. | 156/195 |
| 3,830,373 | 8/1974 | Sixt et al. | 210/489 |
| 3,976,578 | 8/1976 | Beane | 210/489 |
| 4,003,122 | 1/1977 | Overmyer et al. | 405/45 |
| 4,288,321 | 9/1981 | Beane | 210/489 |
| 4,512,827 | 4/1985 | Gill | 156/54 |

FOREIGN PATENT DOCUMENTS

| | | | |
|---|---|---|---|
| 2012146 | 9/1971 | Fed. Rep. of Germany | 210/489 |
| 2352863 | 4/1975 | Fed. Rep. of Germany . | |
| 2555036 | 6/1976 | Fed. Rep. of Germany . | |
| 68874 | 9/1969 | German Democratic Rep. | 210/489 |

OTHER PUBLICATIONS

Agri-book Magazine, vol. II, No. 1, 1985, pp. 6, 8 and 10.

*Primary Examiner*—Merrell C. Cashion, Jr.
*Attorney, Agent, or Firm*—Bacon & Thomas

[57] ABSTRACT

Method and apparatus for encasing drainage pipes, using fibrous or particulate loose filler material guided onto the drainage pipe by means of a hollow screw and held there with a permeable envelope material preferably wound round with a filament. The pitch or number of threads on the screw, the height thereof and the speed at which the screw rotates determine the amount of filler material applied to the drainage pipe per unit of area. The apparatus comprises a machine consisting of a guide tube carrying an internal hollow screw, the drainage pipe being guided in the interior of the screw, the encasing envelope material being placed externally upon the said guide tube and preferably being wound around with a filament at the end of the screw.

8 Claims, 1 Drawing Sheet

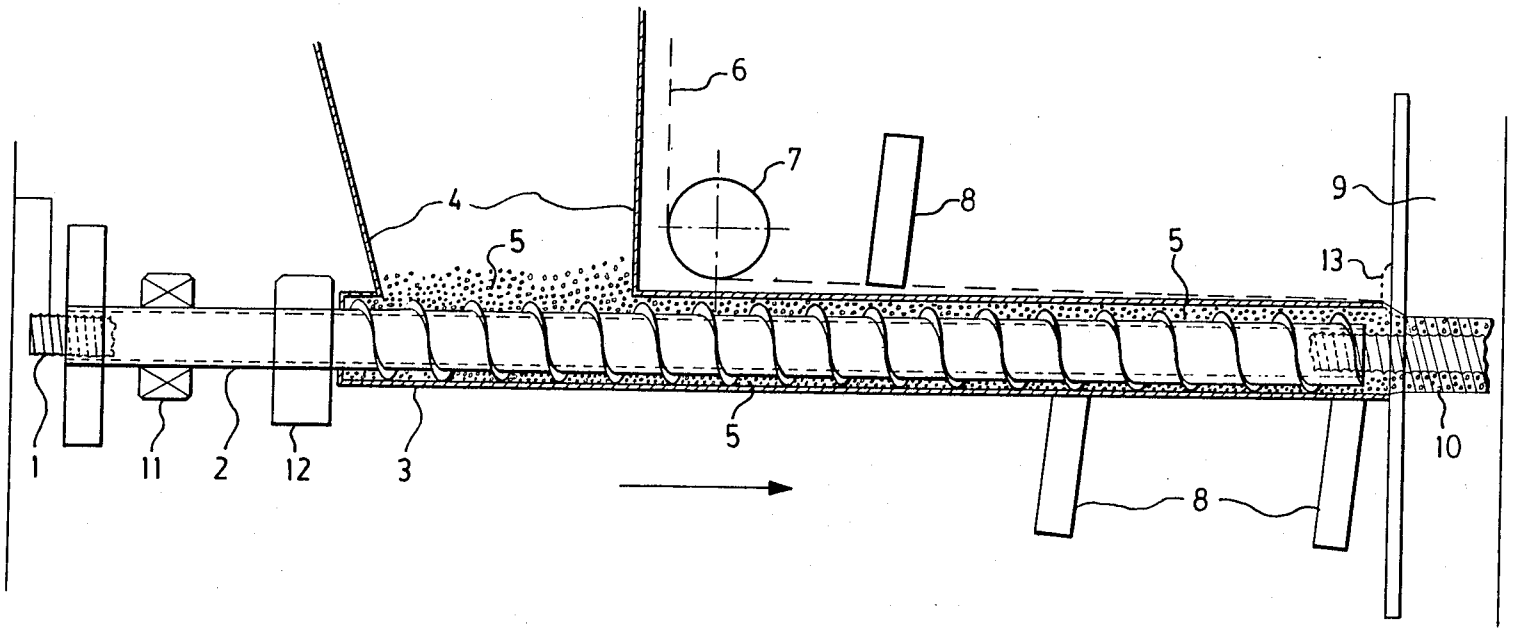
1
2
3
4
5
5
5
6
7
8
8
9
10
11
12
13

METHOD AND APPARATUS FOR ENCASING DRAINAGE PIPES

The invention relates to a method and apparatus for encasing drainage pipes.

It is known to encase drainage pipes in order to obtain the best possible transition between the soil and pipe, with reduced risk of blockages. For the purpose of encasing pipes, use is made of an envelope material which is permeable to liquids and which is usually applied to the pipe. The drainage pipe itself is usually made of plastic with slots arranged at intervals. Depending upon the nature of the soil, these slots close up after the pipe has been laid therein and the purpose of the drainage pipe can then no longer be fulfilled.

In order to prevent drainage pipes from becoming blocked, it has been proposed to provide a more or less large cavity between the drainage pipe and its casing. Whereas the drainage pipe is provided with slots at intervals, and therefore has a relatively small area of openings, the configuration of the casing may be such that the entire surface thereof is permeable to liquids. However, if such a permeable sheath were to be applied directly to the drainage pipe, its effectiveness would also be limited to the area determined by the slots in the pipe.

It is the purpose of the invention to provide a method and apparatus for manufacture of a drainage pipe which may be permeable regardless of the nature of the soil in which it is laid, and also provides increased surface of the pipe which is capable of picking up liquid. According to the invention there is provided a method for encasing drainage pipes, comprising guiding a drainage pipe within a hollow screw driven for rotation about its axis, supplying to the hollow screw a loose, permeable filler material whereby the screw transports the filler material and applies a predetermined amount thereof to the exterior of the drainage pipe, and enclosing the pipe having the filler material applied thereto in a permeable envelope material.

The invention also provides an apparatus for encasing drainage pipes, comprising a storage tank for holding loose filler material, a guide tube connected to the tank, a hollow screw mounted within the guide tube, means for rotating the hollow screw about its axis, and means for guiding a drainage pipe longitudinally through the interior of the hollow screw.

The method and apparatus are adapted for especially advantageously and conveniently manufacturing drainage pipes encased with permeable envelope material permeable to liquids, wherein the envelope material is held at such a distance from the surface of the drainage pipe that blockages produced in the envelope material have no effect upon the liquid flowing in the interior of the pipe.

One particularly preferred form of a method and of an apparatus for manufacture of encased pipe will be described hereinafter by way of example only, with reference to the accompanying single figure of drawings.

BRIEF DESCRIPTION OF THE DRAWINGS

The invention will now be described merely by way of illustration with reference to the single FIGURE of the accompanying drawings which is a somewhat schematic axial section through one embodiment of an apparatus in accordance with this invention.

DESCRIPTION OF A PREFERRED EMBODIMENT

In the drawings, drainage pipe 1 may be either a rigid pipe, preferably made of plastic, or a flexible pipe. It carries peripheral slots or holes spaced at intervals, through which the liquid can pass. This drainage pipe is encased with a permeable envelope material 6, care being taken to ensure that the said permeable material 6 is held sufficiently far away from the surface of the pipe. The spacing means used is a loose filler material which is loose enough to be permeable to liquids. The material may be particulate or fibrous. An example is expanded polystyrene beads or spheres. STYROPOR spheres are particularly satisfactory, but other substances such as natural substances such as tree bark, coconut fibres and the like may also be used.

It has been found desirable in practice to make the thickness of the layer of filler material dependent upon the conditions under which the pipe operates. The greater the danger of blockage, the thicker the layer of filler material. The permeable envelope material has two functions, on the one hand to ensure the necessary permeability for the liquid and, on the other hand, to enclose the loose filler material applied to the pipe so that it meets the requirements even under extreme stress.

This layered casing is obtained by a method in which the filler material is picked up, transported and released to the surface of the drainage pipe by means of a hollow screw 2, e.g. a hollow tube having a helical screw thread or flight on the exterior. The amount of filler material delivered by the screw 2 determines the thickness of the layer to be applied. Encasement with the permeable envelope material starts already in the vicinity of the screw guide, the said screw being guided within a tube so that, when the filler material emerges from the screw area, there is a direct transfer to the cavity formed by the permeable envelope material. The drainage pipe, in turn, is guided centrally within the hollow screw. At the end of the screw it therefore emerges from this cavity and is immediately provided with the corresponding casing.

In order to vary the thickness of the casing, the speed of the screw transporting the filler material and the permeable envelope material, and the rate at which the drainage pipe passes through the hollow screw, can be matched in such a manner as to determine the amount and thickness of the filling The accompanying drawing shows an apparatus for the implementation of the method. The said apparatus consists of a storage tank 4 to which a guide tube 3 is connected directly. The said guide tube is open in the vicinity of the storage tank, so that filler material 5 can reach guide tube 3 within which the hollow screw 2 rotates. This screw is mounted rotatably and has its own drive. The arrangement is such that the screw is easily replaceable, so that screws with threads of different pitch or heights may be used. Drainage pipe 1 is adapted to be guided through the hollow screw 2. In the example illustrated, the drainage pipe passes through the hollow screw 2 from left to right, in the direction of the arrow. A pillow block 11 and a drive 12 serve to mount and rotate the screw 2. The latter, as it rotates, picks up filler material 5 from the storage tank 4 and passes it on within guide tube 3 in the direction of the arrow. At the same time, drainage pipe 1 is pushed through the hollow screw 2 in the direction of the arrow. Located at the end of the screw 2 may be a winding device 9 through which the drainage pipe also passes.

In the example shown a continuous band of permeable envelope material 6 is guided, over a deflecting roller 7, onto the exterior of guide tube 3. With the aid of brushes 8, the said envelope material is applied directly to the surface of guide tube 3. The said envelope material is taken up by winding device 9 and is carried along with the drainage pipe in the direction of the arrow.

The apparatus operates as follows: drainage pipe 1 is introduced into hollow screw 2. Rotation of this screw 2 causes filler material 5 to be carried along in guide tube 3 and to be applied directly to the surface of the drainage pipe 1 at the end of the said guide tube 3 and therefore also at the end of screw 2. During this rotary motion, envelope material 6 is constantly being drawn over tube 3, around which it is wrapped with the aid of brushes 8. The band of material 6 may for example have its edges progressively curved or bent around the tube 3 by the action of the brushes 8 so that ultimately its longitudinal edges are overlapped to form a tubular sheath. Thus at the end of tube 3, a sheath, formed by the said envelope material 6 wrapped longitudinally comes to rest directly upon the drainage pipe coated with filler material 5. In order to ensure that the sheath of envelope material 6 remains in this position, the winding device 9 may have fed to it a filament 13 which, during the rotary motion, is wound around the sheath of material 6, thus uniting the material 6 on the filler material 5 firmly with the drainage pipe 1. The filament 13 may be for example a plastic monofilament, a metal wire or thread of natural or synthetic fibre. Finished drainage pipe 10, thus encased, emerges from the end of the winding device and may be taken up onto drums or the like.

The speed at which the envelope material 6 is drawn over guide tube 3 is preferably constant. The speed of winding device 9 is also preferably kept approximately constant. However, the speed of the screw 2 is variable. This speed rises or falls, depending upon how much filler material 5 is required between the drainage pipe 1 and the envelope material 5, more or less filler material 5 being fed to the end of the guide tube 3 per unit of time. Since the drainage pipe 1 is, at the same time, moving through the hollow screw 2 at an approximately constant speed, it is possible to control the amount of filler material 5 per unit drainage pipe area. This makes it possible to control the thickness of the casing, even without replacing screw 2 with one having different threads.

Instead of wrapping the envelope material 6 longitudinally around the pipe 1 and filler material 5, the envelope material may be wound around the pipe. The envelope material 6 may be for example a non-woven coherent fleece-like band of synthetic or natural fibres, or may be a netting formed from synthetic or natural filaments or yarns. Alternatively, the envelope material may be formed as a seamless tubular element and be fed forwardly over the tube 3 to encase the pipe 1 and filler material as it leaves the end of the tube 3. For example, the envelope material may comprise a tubular element which comprises a coherent mat of fibres bonded together, e.g. a spun-bonded mat, or a netting woven or formed in situ around the exterior of the tube 3. Alternatively, the envelope material may comprise a fabric, for example a knitted, tubular sock, a substantial length, e.g. several hundred feet, of which is slipped over the end of the tube 3 and maintained in a radially expanded and axially compressed, e.g. shirred, form. The sock can be progressively fed forwardly over the advancing pipe 1 and filler material 5 to encase the latter until the length of stored sock is exhausted. The manufacturing process can then be interrupted while a fresh length of the sock is installed over the tube 3.

We claim:

1. A method for encasing drainage pipes which comprises guiding a drainage pipe through a hollow tube having a helical screw on its exterior and disposed within a fixed guide tube, applying a sleeve of a flexible permeable envelope material around said guide tube, advancing said sleeve axially off said guide tube so as to encase said drainage pipe as it leaves said hollow tube, supplying to said screw within said guide tube a loose, permeable filler material, and rotating said hollow tube about its axis thereby to transport the filler material along said screw and to the exterior of the drainage pipe and within said envelope.

2. A method according to claim 1 which comprises varying the speed of rotation of said screw thereby to control the amount of said filler material introduced between said drainage pipe and said permeable envelope.

3. A method according to claim 1 which comprises applying said sleeve by wrapping a continuous band of sleeve material around said screw.

4. A method according to claim 1 which comprises winding a filament around said sleeve after the pipe and filler material have been enclosed thereby to secure said sleeve in position.

5. An apparatus for encasing drainage pipes which comprises:

a storage tank for holding loose filler material, a guide tube connected to the tank for receiving filler material therefrom, a hollow tube mounted within the guide tube and having a helical screw on its exterior and disposed for said screw to receive filler material from said storage tank, means for rotating said hollow tube about its axis thereby to feed filler material therealong, means for disposing a sleeve of permeable envelope material around said guide tube, and means for guiding a drainage pipe longitudinally through said hollow tube and for advancing said sleeve off said guide tube whereby said drainage pipe has said filler material applied to the exterior thereof within said sleeve.

6. An apparatus according to claim 5 which includes brushes arranged around said guide tube and adapted to wrap a continuous band of permeable envelope material around said guide tube thereby to form said sleeve.

7. An apparatus according to claim 5 which additionally comprises at the end of the hollow tube a winding device adapted to wind a filament around filled encased drainage pipe leaving said hollow tube.

8. An apparatus according to claim 5 in which said hollow tube is replaceable with ones having screws of differing threads.

* * * * *